US006644829B1

(12) United States Patent
Tracy et al.

(10) Patent No.: US 6,644,829 B1
(45) Date of Patent: Nov. 11, 2003

(54) ROTATABLE LIGHT DEVICE AND METHOD

(75) Inventors: Richard Tracy, Muskogee, OK (US); Kenneth Smith, Porum, OK (US)

(73) Assignee: Optronics, Inc., Muskogee, OK (US)

( * ) Notice: Subject to any disclaimer, the term of this patent is extended or adjusted under 35 U.S.C. 154(b) by 0 days.

(21) Appl. No.: 10/137,614

(22) Filed: May 2, 2002

(51) Int. Cl.[7] ..... F21V 21/092

(52) U.S. Cl. ..... 362/220; 362/223; 362/397; 362/269; 362/360

(58) Field of Search ..... 362/397, 35, 191, 362/220, 223, 231, 232, 260, 269, 370, 371, 396, 427, 477, 426; 43/17.5

(56) References Cited

U.S. PATENT DOCUMENTS

| | | | | |
|---|---|---|---|---|
| 3,096,109 A | | 7/1963 | Callahan | 403/385 |
| 3,640,498 A | | 2/1972 | Aleks | 248/218.4 |
| 3,838,267 A | | 9/1974 | Eggers et al. | 362/222 |
| 3,936,670 A | | 2/1976 | Allen, Sr. | 362/258 |
| 4,194,459 A | | 3/1980 | Lisowski | 114/221 R |
| 4,338,875 A | | 7/1982 | Lisowski | 114/221 R |
| 4,729,535 A | | 3/1988 | Frazier et al. | 248/230.4 |
| 4,799,444 A | | 1/1989 | Lisowski | 114/221 R |
| 4,881,156 A | | 11/1989 | Shemitz et al. | 362/220 |
| 5,175,437 A | * | 12/1992 | Waluszko | 250/504 R |
| 5,335,149 A | | 8/1994 | Evans | 362/477 |
| 5,361,195 A | * | 11/1994 | Chen | 362/397 |
| 5,416,676 A | | 5/1995 | Carpenter | 362/158 |
| 5,436,815 A | * | 7/1995 | Grooms et al. | 362/216 |
| 5,491,621 A | | 2/1996 | Duty | 362/397 |
| 5,504,342 A | * | 4/1996 | Jaynes et al. | 250/504 R |
| 5,702,082 A | | 12/1997 | Evans et al. | 248/230.1 |
| 6,120,163 A | | 9/2000 | Graber et al. | 362/223 |
| 6,174,078 B1 | * | 1/2001 | Ohm et al. | 362/477 |
| 6,474,851 B1 | * | 11/2002 | Baley | 362/477 |

* cited by examiner

*Primary Examiner*—Sandra O'Shea
*Assistant Examiner*—Hargobind S. Sawhney
(74) *Attorney, Agent, or Firm*—Head, Johnson & Kachigian

(57) ABSTRACT

A rotatable light device having at least a pair of light bulbs. An elongated bulb housing retains the light bulbs. The bulb housing has an axis of rotation passing through a pair of opposed bushings, with at least one set of power supply wires extending from the bulbs through one of the bushings. A pivot bracket receives the bushings so that the bulb housing can rotate with respect to the bracket 360° about the axis. Alternate and replaceable fastening mechanisms are provided extending from the pivot bracket with the fastening mechanisms being detachable from the bracket.

11 Claims, 7 Drawing Sheets

ROTATABLE LIGHT DEVICE AND METHOD

BACKGROUND OF THE INVENTION

1. Field of the Invention

The present invention is directed to a rotatable light device having multiple bulbs for different applications and having a housing which can rotate 360° about an axis for positioning in any chosen location. In particular, the present invention is directed to a rotatable light device having alternate and removable fastening mechanisms.

SUMMARY OF THE INVENTION

It is often desirable to mount a light in various different locations and on various different elements or surfaces, such as, for example, on a boat or vessel.

It is an object and purpose of the present invention to rotate and position a light device to any selected position in a 360° radius. It is a further object and purpose of the invention to provide a light device capable of rotating 360° without interfering with or damaging power supply wires.

It may also be desirable to direct light in the interior of a boat. Accordingly, it is desirable to rotate a light device that has been mounted to a boat in various positions and orientations.

It is sometimes desirable to provide a black light for providing light from a boat over water so that phosphorescent fishing line will be illuminated without otherwise illuminating a fishing area.

It is a further object and purpose of the present invention to provide a rotatable light device having multiple, alternate fastening mechanisms to fasten the light device to a boat.

It is an additional object and purpose of the present invention to provide a rotatable light having a suction cup fastening mechanism for attachment to flat surfaces and an alternate rail mount clamp mechanism for attachment to a rail.

It is an additional object and purpose of the present invention to provide a rotatable light device having rail mount clamps which are removable and attachable without dismantling the railing or otherwise scratching or drilling into the railing.

It is a further object and purpose of the present invention to provide a rotatable light device having rail mount clamps which may be affixed to a pivot bracket by a tongue and groove arrangement.

The present invention is directed to a rotatable light device which includes an elongated bulb housing retaining a pair of flourescent light bulbs. The elongated bulb housing has an axis of rotation therethrough. The axis passes through a pair of opposed bushings which will be received in a pivot bracket. The bulb housing also retains a lens which may be clear or colored but is generally translucent.

The rotation light device includes alternate and removable fastening mechanisms in order to fasten the light device to a chosen structure. The fastening mechanisms include a suction cup fastening mechanism and a rail lock fastening mechanism.

The rail lock mechanism extends from the pivot bracket and may be attached to the pivot bracket by a tongue and groove assembly. The rail lock mechanism will include a pair of rail locks which, when closed, form aligned cylindrical openings for receiving a rail.

An alternate, suction cup fastening mechanism is provided for fastening the light device to a surface. A pair of spaced apart suction cups will extend from the pivot bracket.

The pivot bracket has a pair of parallel opposed legs which extend from the base of the pivot bracket. The legs each include an opening which, when installed, will be aligned with the axis of rotation. On one side a knob having a bushing therein will extend through the opening in the leg and through a left cap and into the housing. On the opposed side, a bushing will pass through a right cap and through the leg and into the housing. The bushing has a central opening therethrough so that power supply wires or cords may pass from inside to outside of the housing. The bulb housing is capable of being rotated 360° about the axis of rotation with respect to the pivot bracket so that the bulb housing is moved to any desired position.

BRIEF DESCRIPTION OF THE DRAWINGS

FIG. 2 illustrates the rotatable light device shown in FIG. 1 from an alternate perspective view with the rail lock mechanism attached to the device while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
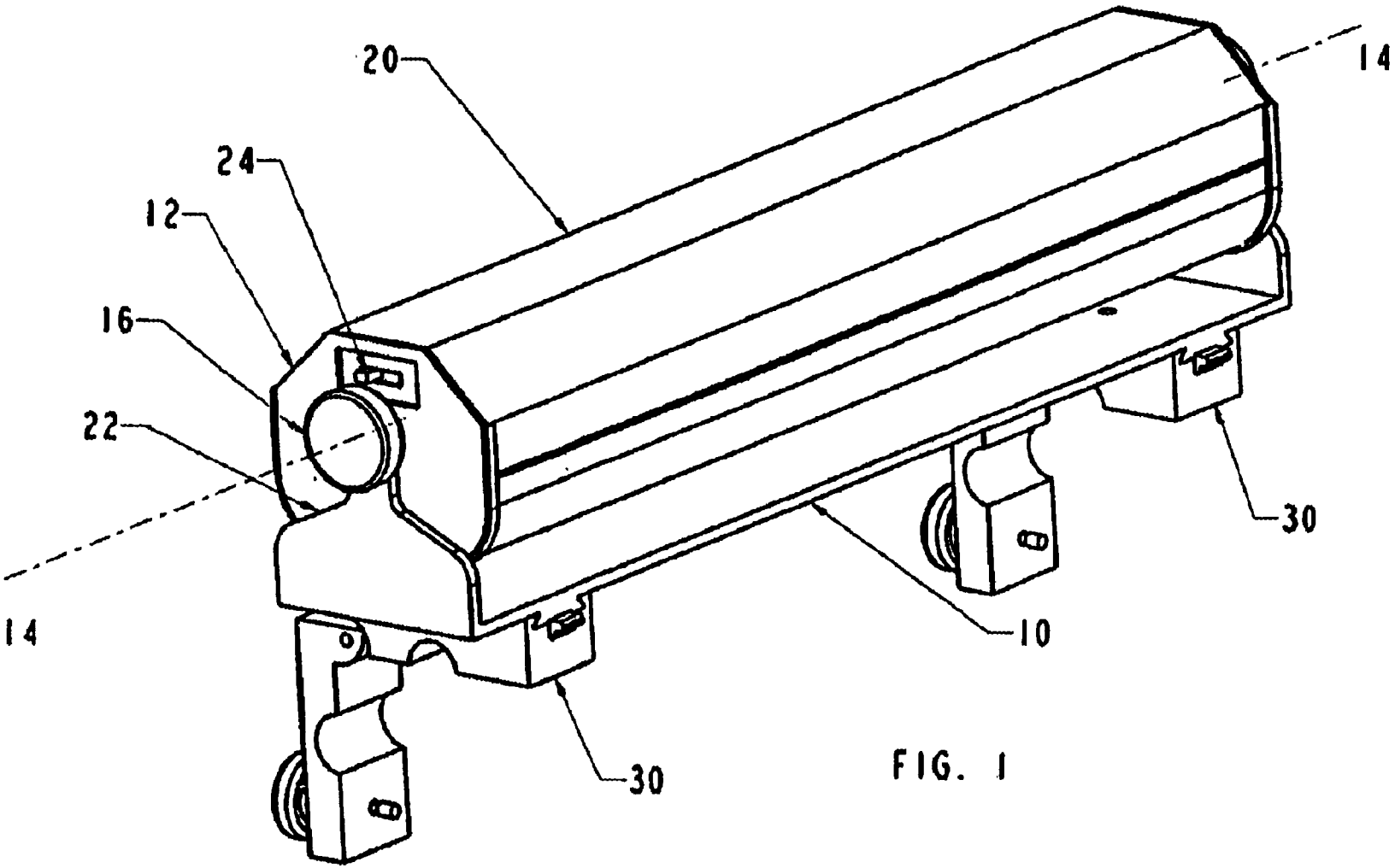
FIG. 1 is a perspective view of a rotatable light device constructed in accordance with the present invention illustrating one embodiment having a rail lock mechanism.

Referring to the drawings in detail, FIG. 1 illustrates a perspective view of one embodiment of a rotatable light device 10.

The rotatable light device 10 includes an elongated bulb housing 12 having an axis of rotation therethrough illustrated by dashed lines 14. The axis of rotation passes through a pair of opposed bushings 16 and 18 (only one bushing visible in FIG. 1). As will be described herein, the bulb housing 12 retains a pair of flourescent light bulbs.

The bulb housing 12 also retains a lens 20 which may be clear or colored but is generally translucent to permit passage of light therethrough.

A switch 24 may be positioned so that one light bulb is lit, or so that both bulbs are lit.

The opposed bushings 16 and 18 will be received in a pivot bracket 22, a portion of which is visible in FIG. 1.

The rotatable light device 10 includes alternate and removable fastening mechanisms in order to fasten the light device to a chosen structure. In the present embodiment, the fastening mechanisms may include a suction cup fastening mechanism and a rail lock fastening mechanism. The suction cup fastening mechanism may be used to secure the rotatable light device 10 to a flat surface such as on a boat. Alternatively, the rail lock mechanism 30 may be used to secure the device to a boat rail or the like.

Figure 2:
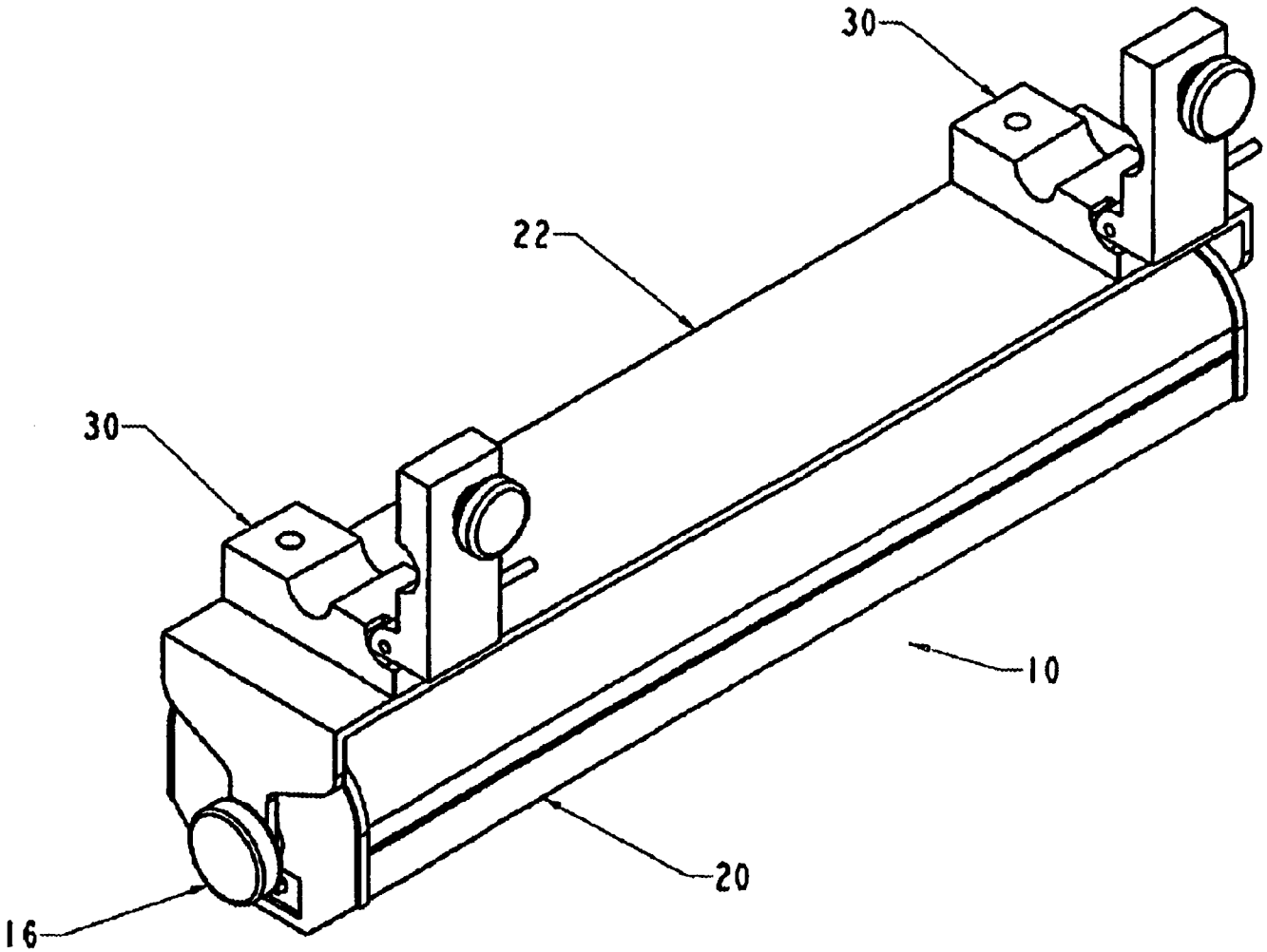
Figure 3:
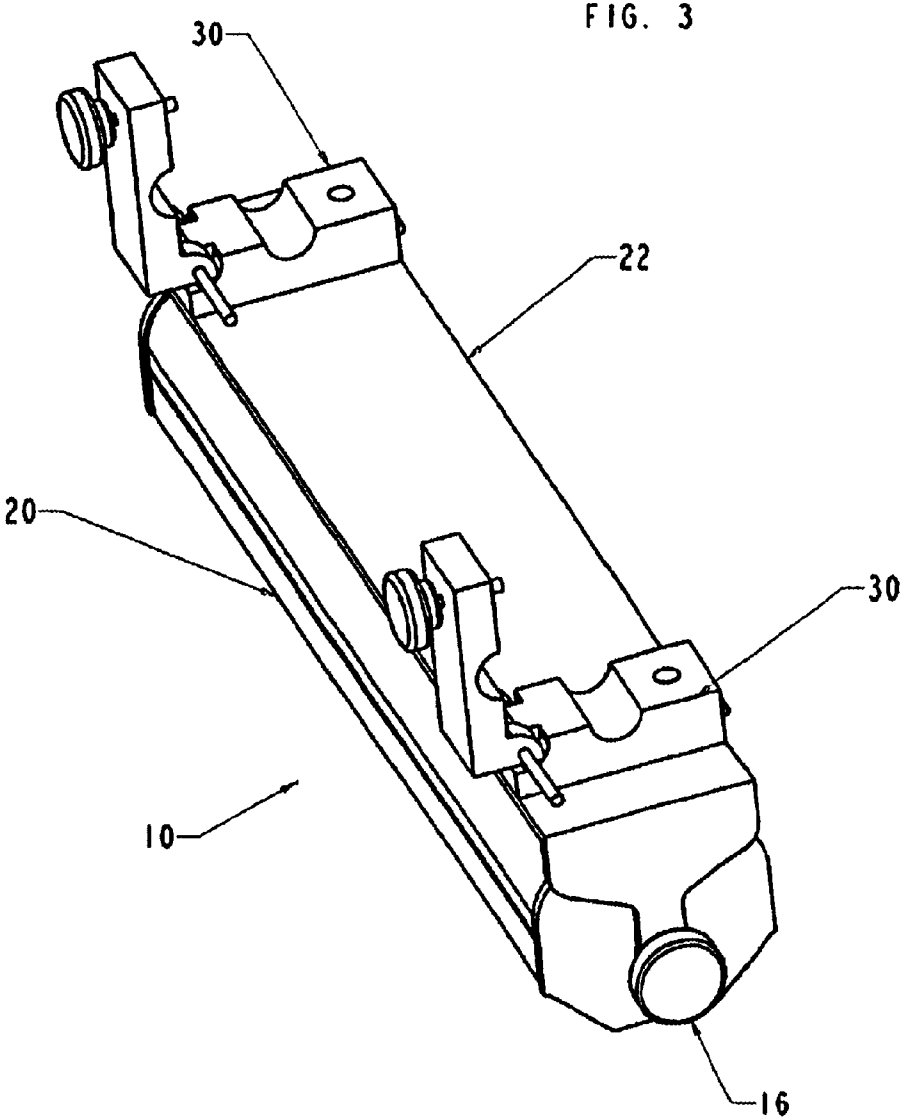
FIG. 3 illustrates the rotatable light device with the rail lock mechanism apart from the device.

The rail lock mechanism 30 is illustrated in FIG. 1. FIG. 2 illustrates the light device 10 with the rail lock mechanism 30 attached to the pivot bracket 22 while FIG. 3 illustrates the rail lock mechanism 30 apart from the pivot bracket 22. The rail lock mechanism 30 may be attached to the pivot bracket by a tongue and groove assembly to be described in detail herein. The rail lock mechanism 30 will include a pair of rail locks which, when in the closed position, will form aligned cylindrical openings for receiving a rail (not shown). When not in use, the rail lock mechanism 30 may be removed from the pivot bracket 22 of the light device 10 and replaced with an alternate fastening mechanism.

Figure 6:
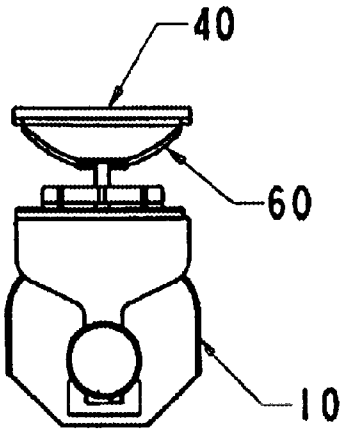
FIG. 6 illustrates an end view of the rotatable light device of the present invention having an alternate, suction cup fastening mechanism.
Figure 5:
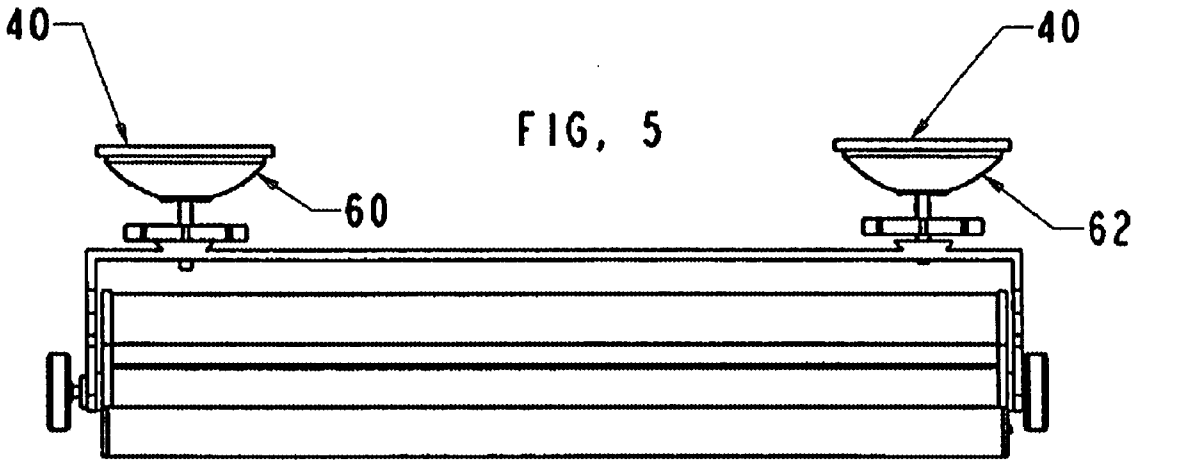
FIG. 5 illustrates a side view.
Figure 4:
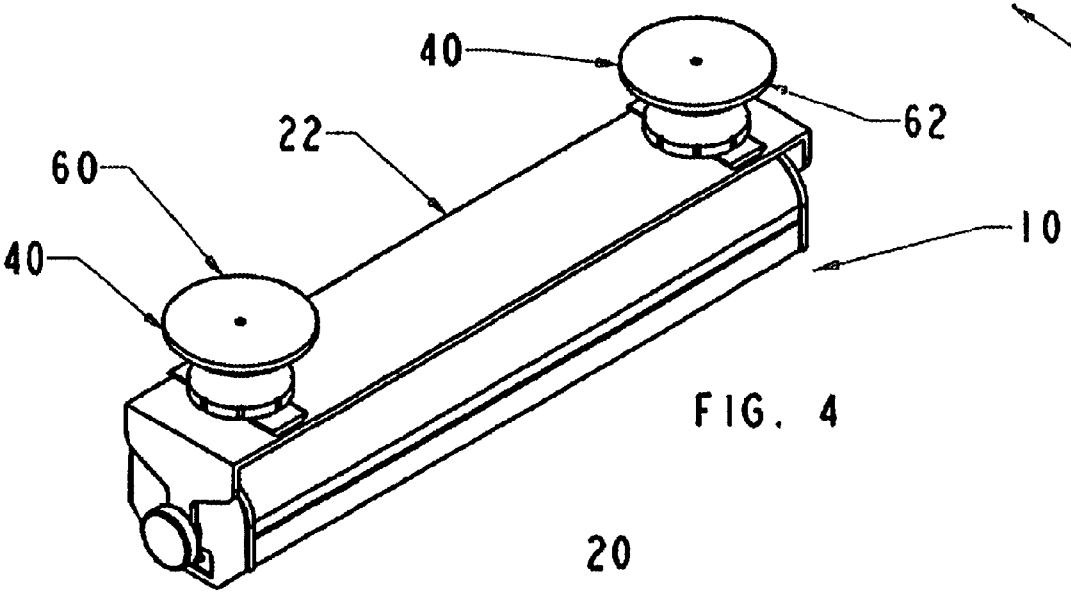
FIG. 4 illustrates a perspective view.

FIG. 4 illustrates a perspective view, FIG. 5 illustrates a side view and FIG. 6 illustrates an end view of rotatable light device 10 with an alternate, suction cup fastening mechanism 40 for fastening the light device 10 to a flat surface (not shown). A pair of spaced apart suction cups 60 and 62 will extend from the pivot bracket 22.

Figure 7:
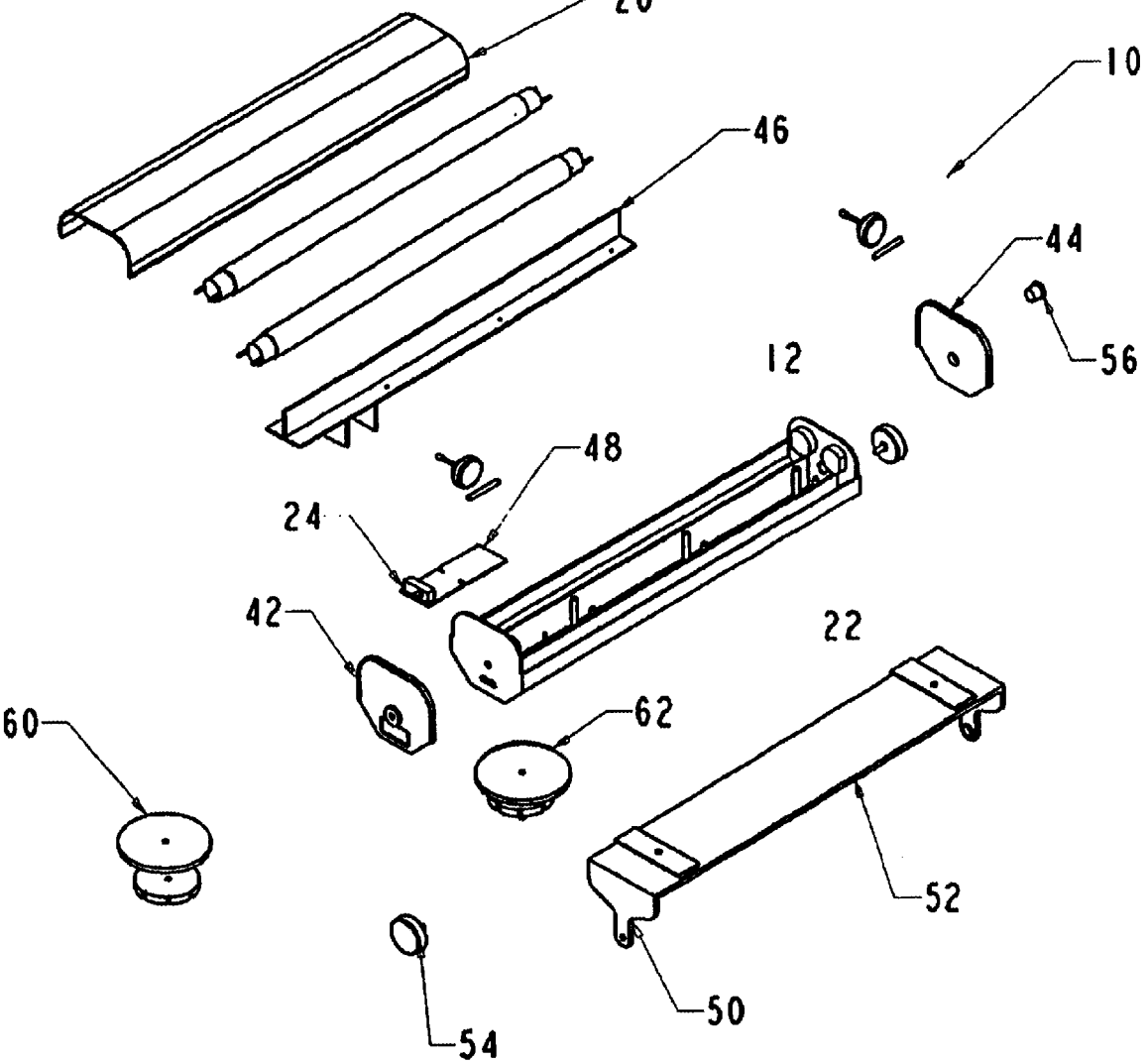
FIG. 7 illustrates an exploded view of the rotatable light device shown in FIGS. 4, 5 and 6.

FIG. 7 illustrates an exploded view of the rotatable light device 10 utilizing the suction cup fastening mechanism 40. The bulb housing 12 includes a receptacle to receive a pair of flourescent light bulbs. In one embodiment, one flourescent light will be a standard white light while the other flourescent light will be a black light (bulbs not shown in FIG. 7). In one application, the black light might be used to illuminate phosphorescent fishing line.

The bulb housing 12 also includes a left cap 42 and a right cap 44 which are parallel to each other. A center member 46 is retained in the housing to separate the light bulbs and act as a reflector. The translucent lens 20 will snap fit over the open receptacle of the bulb housing 12. The switch 24 will be connected to a transformer within the bulb housing 12.

The pivot bracket 22 has a pair of parallel, opposed legs 50 and 52 which extend from the base of the pivot bracket. The legs 50 and 52 each include an opening which, when installed, will be aligned with the axis of rotation 14. On one side, a knob 54 having the bushing 16 therein will extend through the opening in the leg 50, through an opening in the left cap 42 and into the housing 12. On the opposed side, a bushing 56 will pass through an opening in the right cap 44 and through the leg 52 and into the housing 12. The bushing 56 has a central opening therethrough so that power supply wires or cords pass from inside the housing 12. Rotation of the housing will not interfere with the power supply wires.

The suction cup mechanism 40 includes a pair of suction cups 60 and 62 which will be connected to the pivot bracket 22 by fasteners such as threaded screws (not seen in FIG. 7). In one preferred embodiment, the fasteners are rigidly mounted to the suction cups 60 and 62. Threaded openings in the pivot bracket 22 receive the fasteners and pass through a pair of tongues, to be described in detail herein. Accordingly, the suction cups may be rotated clockwise to attach and counter clockwise to remove. The suction cups 60 and 62 will adhere to a flat surface so that the pivot bracket is stationary. It will be observed that the suction cups 60 and 62 may be removed from the device in the event that an alternate fastening mechanism is desired.

Figure 8:
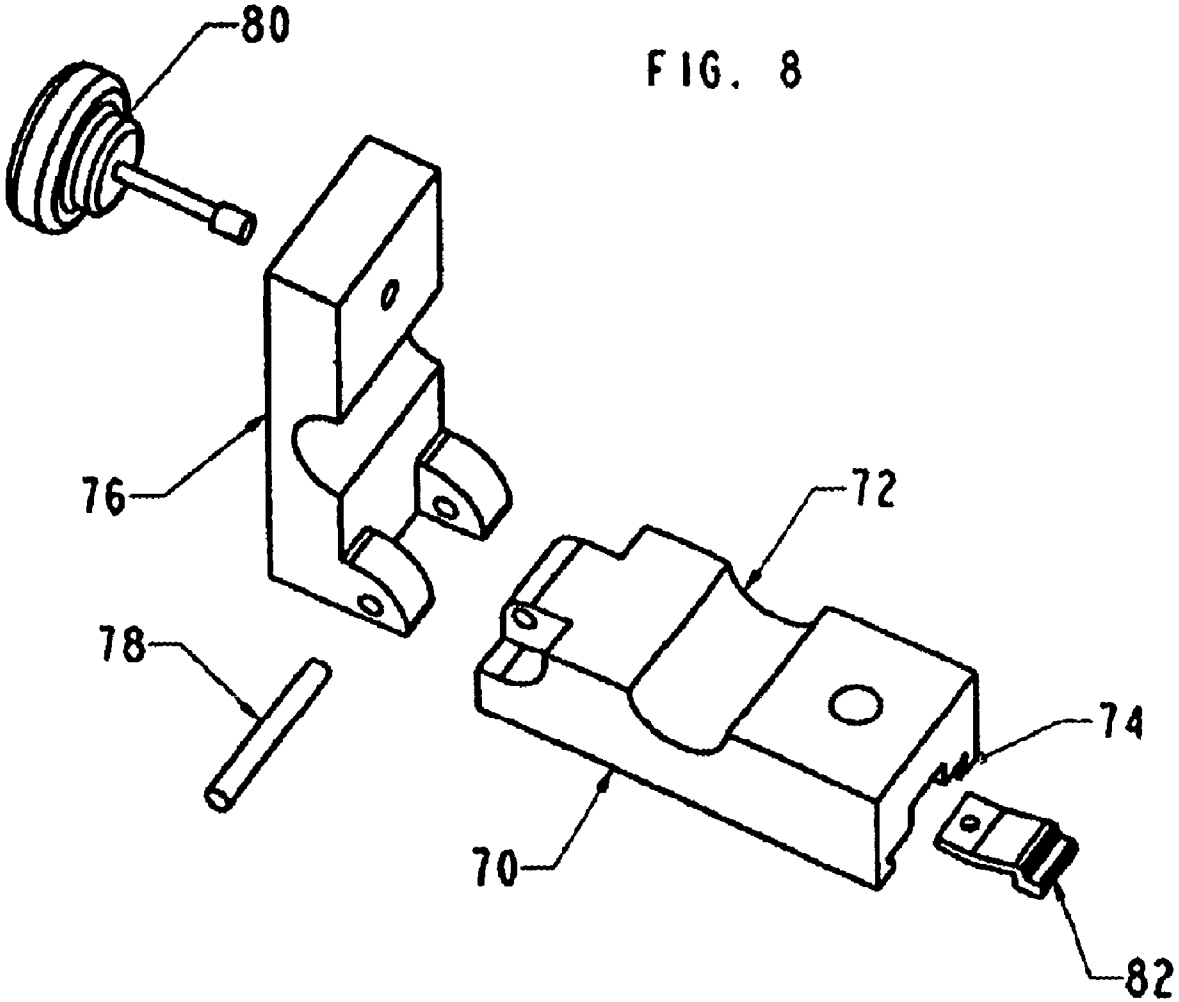
FIG. 8 illustrates an exploded view of the rail lock mechanism which is a part of the rotatable light device of the present invention.

FIG. 8 illustrates an exploded view of one of the rail locks of the rail lock mechanism 30 apart from the rotatable light device 10. The rail lock includes a top rail portion 70 having an arcuate opening 72 on one side and a groove 74 therethrough on the other side. The rail lock also includes a rail mount 76 which is hinged to the top rail portion 70 by a hinge pin 78. When in the closed position, the rail mount and top rail close to form a cylindrical opening. The top rail and rail mount are held in closed position by a top rail lock screw 80 which passes through an opening in the rail mount and into the top rail portion 70. A spring stop 82 is used to retain the pivot bracket 22 from movement in relation to the rail lock mechanism.

Figure 10:
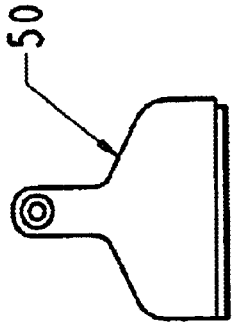
FIG. 10 is an end view and FIG. 11 is a top view of a pivot bracket apart from the rotatable light device of the present invention.
Figure 11:
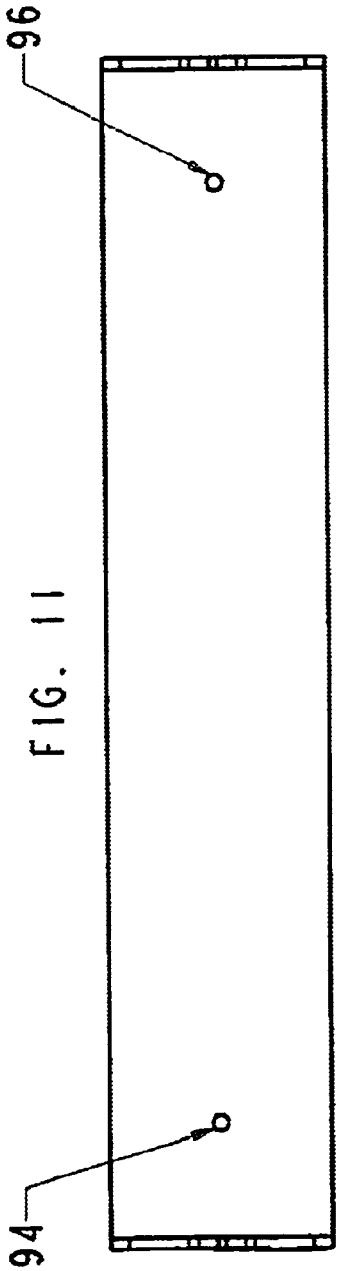
Figure 9:
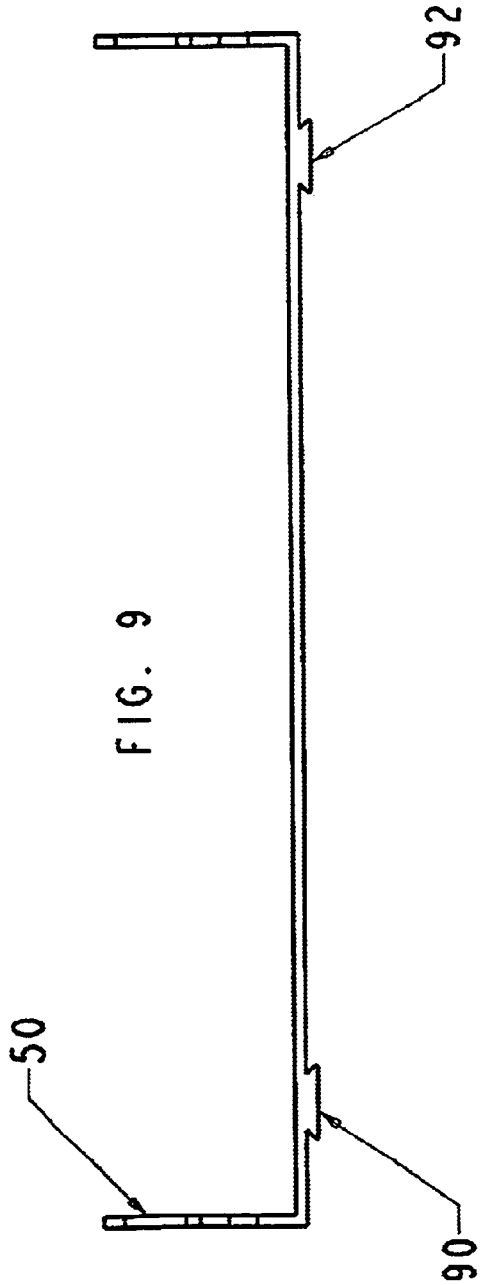
FIG. 9 is a side view.

FIG. 9 illustrates a side view, FIG. 10 illustrates an end view and FIG. 11 illustrates a top view of the pivot bracket 22 apart from the rotatable light device. One leg 50 is visible in the end view in FIG. 10. As seen in the side view in FIG. 9, the pivot bracket includes a base from which the legs 50 and 52 project. Extending from the base are a pair of parallel tongues 90 and 92 which will receive the rail lock mechanism previously described.

As best seen in the top view in FIG. 10, the pivot bracket also includes a pair of threaded openings 94 and 96 which will receive the fasteners from the suction cups 60 and 62.

Accordingly, the pivot bracket 22 will be fixed to a chosen structure by one of the alternate fastening mechanisms and the bulb housing 12 will be permitted to rotate 360° about the axis of rotation to any desired position.

Whereas, the present invention has been described in relation to the drawings attached hereto, it should be understood that other and further modifications, apart from those shown or suggested herein, may be made within the spirit and scope of this invention.

What is claimed is:

1. A rotatable light device having alternate and removable fastening mechanisms, which device comprises:

at least one light bulb;

an elongated bulb housing to retain said at least one bulb, said bulb housing having an axis of rotation passing through a pair of opposed bushings;

a pivot bracket receiving said opposed bushings so that said bulb housing can rotate with respect to said bracket 360° about said axis; and a suction cup fastening mechanism for attachment to a flat surface and a rail lock fastening mechanism for attachment to a rail, each of said fastening mechanisms detachable from said pivot bracket.

2. A rotatable light device as set forth in claim 1 wherein said at least one light bulb includes a pair of flourescent bulbs.

3. A rotatable light device as set forth in claim 2 wherein said pair of flourescent bulbs includes at least one black light.

4. A rotatable light device as set forth in claim 1 wherein said bulb housing includes a translucent lens.

5. A rotatable light device as set forth in claim 1, wherein said suction cup mechanism includes a pair of suction cups fastened to said bracket by fasteners.

6. A rotatable light device as set forth in claim 1, wherein said rail lock mechanism includes a pair of parallel tongues extending from said pivot bracket, a pair of top rails each having a groove therein adapted to slidably receive said tongues, and a rail mount hinged to said top rail.

7. A rotatable light device as set forth in claim 6 wherein each said top rail includes a spring stop.

8. A rotatable light device as set forth in claim 1 including at least one set of power supply wires extending from said at least one bulb through one of said bushings.

9. A rotatable light device having alternate and removable fastening mechanisms, which device comprises:

a pair of flourescent bulbs, at least one of which is a black light;

an elongated bulb housing to retain said bulbs, said bulb housing having an axis passing through a pair of opposed bushings, with at least one set of power supply wires extending from said bulbs through one of said bushings;

a pivot bracket receiving said opposed bushings so that said bulb housing can rotate with respect to said bracket 360° about said axis; and suction cup mechanism for attachment to a flat surface and a rail lock mechanism for attachment to a rail said suction cup mechanism and said rail mount clamp mechanism each being detachable from said pivot bracket.

10. A method to secure and position a rotatable light device, which method comprises:

rotating a bulb housing having at least one light bulb therein with respect to a pivot bracket about an axis to a desired position anywhere within a 360° radius;

choosing between a suction cup fastening mechanism for a flat surface structure and a rail lock fastening mechanism for a rail structure connecting one of said fastening mechanisms to said pivot bracket; and utilizing said one chosen fastening mechanism to secure said pivot bracket to a desired structure.

11. A method to secure and position a rotatable light device, which method comprises:

rotating a bulb housing having at least one light bulb therein with respect to a pivot bracket about an axis to a desired position anywhere within a 360° radius;

choosing between a suction cup fastening mechanism for a flat surface structure and a rail lock fastening mechanism for a rail structure;

connecting one of said fastening mechanisms to said pivot bracket including inserting a rail lock assembly having a pair of grooves onto a pair of tongues extending from said pivot bracket; and utilizing said one chosen fastening mechanism to secure said pivot bracket to a desired structure.

* * * * *